United States Patent [19]

van Mullekom

[11] 4,187,888

[45] Feb. 12, 1980

[54] SUPPLY SYSTEM FOR A PNEUMATIC WEAVING MACHINE

[75] Inventor: Hubert P. van Mullekom, Deurne, Netherlands

[73] Assignee: Ruti-te Strake B.V., Deurne, Netherlands

[21] Appl. No.: 939,708

[22] Filed: Sep. 3, 1978

[30] Foreign Application Priority Data

Aug. 25, 1977 [NL] Netherlands ..... 7709425

[51] Int. Cl.[2] ..... D03D 47/30

[52] U.S. Cl. ..... 139/435

[58] Field of Search ..... 139/435; 226/91, 95, 226/97

[56] References Cited

U.S. PATENT DOCUMENTS 4,020,877 5/1977 Spisiak et al. ..... 139/435

4,102,361 7/1978 Tanaka et al. ..... 139/435

4,102,362 7/1978 Tojo ..... 139/435

FOREIGN PATENT DOCUMENTS 462061 10/1968 Switzerland ..... 139/435

*Primary Examiner*—Henry Jaudon

*Attorney, Agent, or Firm*—Marshall & Yeasting

[57] ABSTRACT

A supply system for a pneumatic weaving machine, comprising a pressurized air container connected to a pressurized air conduit through a main control valve, a main blowing nozzle and a number of (groups of) auxiliary blowing nozzles, which are each connected through a control valve to the pressurized air container, whereby the blowing nozzles are together connected with an auxiliary supply conduit, which is adapted to be selectively used.

2 Claims, 1 Drawing Figure

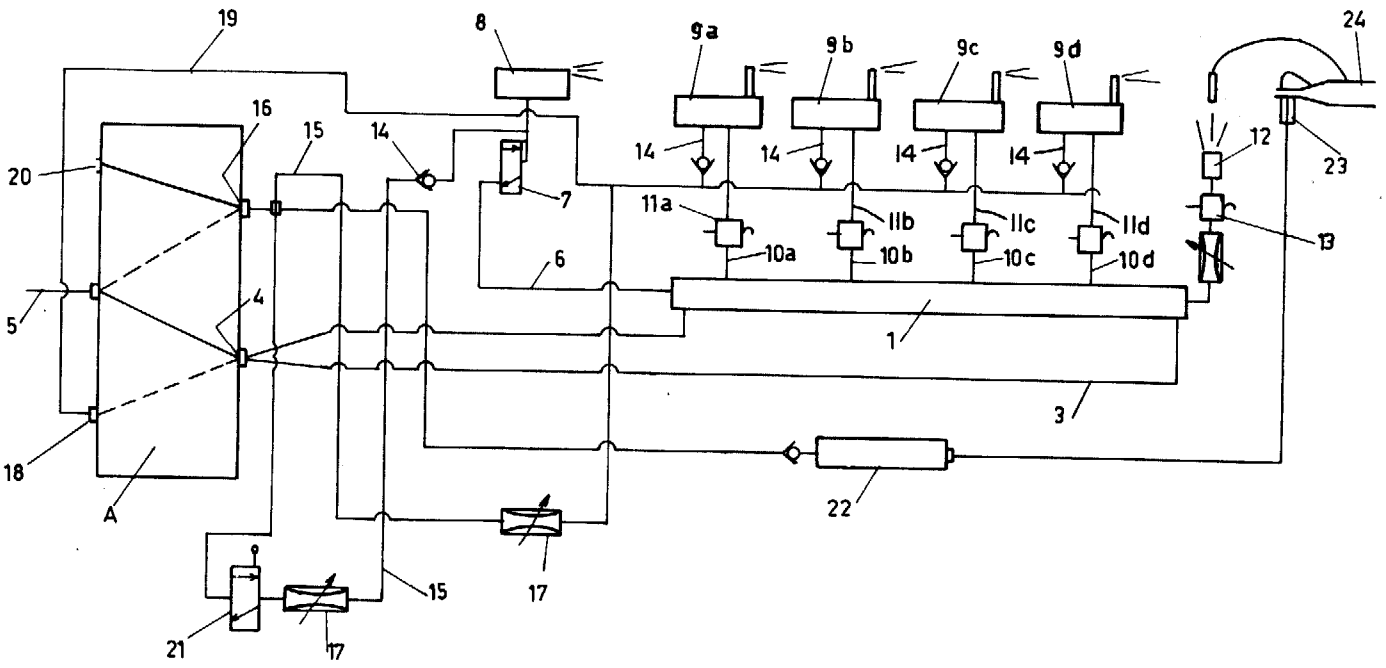
24
23
13
12
11d
10d
9d
14
11c
10c
9c
14
11b
10b
9b
14
10a
9a
14
11a
3
1
22
8
7
6
17
14
15
17
15
16
4
19
9
21
A
20
5
18

SUPPLY SYSTEM FOR A PNEUMATIC WEAVING MACHINE

The invention relates to a supply system for a pneumatic weaving machine, comprising a pressurized air container connected to a pressurized air conduit through a main control valve, a main blowing nozzle and a number of (groups of) auxiliary blowing nozzles, which are each connected through a control valve to the pressurized air container.

Supply systems of this type are known. With these systems the control valves are controlled in such a way, e.g. by a cam shaft, that the main blowing nozzle is supplied by air under pressure from the very beginning of the weft inserting phase and then the (groups of) auxiliary blowing nozzles are successively supplied by air under pressure, substantially in synchronism with the progress of the transport of the weft through the shed. This procedure is taking place during normal operation of the weaving machine.

A problem is encountered when a new weft has to be introduced to the shed as the first action at the beginning of a starting-up procedure. The introduction of such a weft cannot be simply effected by putting the machine into operation e.g. by just depressing a button. Instead it has been the usual practice so far to introduce the first weft by hand into the shed. Only aftr the first weft has been introduced into the shed, the machine is put into operation.

Of course this is a roundabout way of doing.

The present invention aims at solving this problem by taking measures as a result of which the weft insertion in the starting-up phase may be effected in a more efficient way.

For this purpose, according to the present invention the blowing nozzles are also together connected with an auxiliary supply conduit, which is adapted to be selectively used.

Due to this measure a weft may be introduced into the shed at the start of an operational period by simply switching on the supply of air under pressure through the auxiliary supply conduit. The main blowing nozzle and the auxiliary blowing nozzles will then be simultaneously fed with air under pressure, which ensures a correct transport of the weft through the weaving shaft provided of course that a sufficient weft yarn length is kept available at the inlet end of the main blowing nozzle. Then the machine may be put into operation, after which the beating up of the said weft will take place before the second weft inserting phase is taking place. In this further weft inserting phase the supply of air under pressure to the auxiliary blowing nozzles will take place in synchronism with the progress of the transport of said further weft through the shed.

In a practical embodiment of the invention each of the blowing nozzles or group of blowing nozzles is connected with said auxiliary supply conduit through a check valve, the main control valve being constructed so that the auxiliary supply conduit is, under normal operational conditions, vented through the main control valve, whereas it is connected with said pressurized air conduit when the main control valve is in its position corresponding to stillstand of the machine, the pressurized air container being then relieved towards the auxiliary supply conduit through a check valve. For the starting-up procedure of the machine the main control valve may thus be left for some time in the stillstand position, in which position the blowing nozzles are simultaneously fed by air.

According to a further feature of this invention the connection between the main blowing nozzle and the auxiliary supply conduit contains a normally closed valve, adapted to be opened at will. The advantage of this feature is, that with stillstanding machines and with the air pressure source being switched on, only the auxiliary blowing nozzles are fed by air under pressure and that the supply of air to the main blowing nozzle is taking place only when said valve is actuated for a short period of time during the starting-up procedure.

The invention will hereinafter further explained by reference to the accompanying drawing which is a block diagram schematically illustrating the general arrangement of a fluid supply system for a pneumatic weaving machine.

With reference to the drawing 1 indicates the pressurized air container, which is connected with the gate 4 of the main control valve A through conduits 2 and 3, said main control valve connecting—when in the position shown in the drawing—the pressurized air container 1 with the air pressure conduit 5. The main blowing nozzle 8 is connected with the pressurized air container 1 through a connecting passage 6 and a valve 7 mounted in said passage and controlled by the machine. A number of (groups of) auxiliary blowing nozzles 9*a*, 9*b* . . . is also connected with said pressurized air container 1 through branches passages 10*a*, 10*b* . . . , there being in each of said branches passages a valve 11*a*, 11*b* . . . actuated by a cam of a cam shaft control by the weaving machine. This part of the device may be constructed in accordance with the construction shown in the Dutch patent application 7709425, corresponding to U.S. patent application 939,709, the specification of which is incorporated herein by reference. By 12 a so-called tensioning nozzle is indicated (vide U.S. Pat. No. 4,096,889), which is located at the end of the weft path through the shed and which is connected with the pressurized air container through a valve 13 which is also controlled by the machine.

The main blowing nozzle 8 and the auxiliary blowing nozzles or groups of auxiliary blowing nozzles 9*a* . . . 9*d* are each also connected with an auxiliary supply conduit 15 through a check valve 14, said auxiliary supply conduit being connected with the gate 16 of the main control valve A. When the main control valve A is in its position shown by dotted lines, the auxiliary supply conduit 15 is connected through the gate 16 with the air pressure conduit 5, whereas the pressurized air container 1 is relieved through the gate 18 of the main control valve A and an auxiliary conduit 19. When the main control valve a is in its position shown by full lines, the auxiliary supply conduit 15 is relieved through the gate 16 a port 20 and the air container 1 is connected through the gate 4 to the air pressure conduit 5.

The position of the main control valve indicated by dotted lines corresponds with the position of stillstand of the machine. In this condition—when the pressurized air source is switched on—the auxiliary blowing nozzles 9*a* . . . 9*d* are fed by the auxiliary supply conduit 15 through the gate 16 and the respective reduction valve 17 with air of reduced pressure. In the part of the auxiliary supply conduit 15, to which the main blowing nozzle 8 is connected, there is a valve 21, which may be opened at will e.g. by foot actuation so as to supply air to the main blowing nozzle, also through the gate 16.

During this time the tensioning nozzle 12 is not powered. Instead a pressurized air storage device 22 is fed, also through gate 16, from which storage device a so-called starting nozzle 23 (disclosed in the Dutch patent application 7605882, the specification of which is included herein by reference) is supplied with air, which is taking care of the leading end of the first weft after the starting-up procedure will arrive at the suction mouth indicated at 24.

What we claim is:

1. A supply system for a pneumatic weaving machine comprising a source of air under pressure, a pressurized air container, main air conduit means, a main control valve, the main air conduit means connecting the container to the main control valve and the main control valve connecting the main air conduit means to the source of air, blowing nozzles operatively connected to the air container, auxiliary air conduit means connecting the main control valve to the blowing nozzles, and reduction valve means in the auxiliary air conduit means for supplying air of reduced pressure to the nozzles to insert weft yarn into the machine when starting the machine, the main control valve venting the auxiliary air conduit means and connecting the main air conduit means to the source of air under operational conditions and venting the container and connecting the auxiliary air conduit means to the source of air when the machine is stopped.

2. A supply system according to claim 1 wherein one of the nozzles is a main blowing nozzle and in the auxiliary air conduit means connecting the main control valve to the main blowing nozzle there is a normally closed valve adapted to be opened at will.

* * * * *